United States Patent [19]

Sedille et al.

[11] Patent Number: 4,776,757

[45] Date of Patent: Oct. 11, 1988

[54] CENTRIPETAL OR HELICOCENTRIPETAL TURBINE COMPRISING A VOLUTE HAVING A VARIABLE GEOMETRY AND AN ORIENTABLE DISTRIBUTING VANE, IN PARTICULAR FOR A TURBOCOMPRESSOR FOR MOTOR VEHICLES

[75] Inventors: Marcel Sedille, Paris; Maurice Le Creurer, Taverny, both of France

[73] Assignees: Automobiles Peugeot, Paris; Automobiles Citroen, Neuilly-sur-Seine, both of France

[21] Appl. No.: 19,656

[22] Filed: Feb. 27, 1987

[30] Foreign Application Priority Data

Feb. 28, 1986 [FR] France ..... 8602814

[51] Int. Cl.[4] ..... F01B 25/02

[52] U.S. Cl. ..... 415/164; 415/163; 415/158; 415/161

[58] Field of Search ..... 415/157, 158, 159, 160, 415/161, 162, 163, 164, 165, 166, 186; 60/602

[56] References Cited

U.S. PATENT DOCUMENTS

| | | | |
|---|---|---|---|
| 2,648,195 | 8/1953 | Wilde et al. | 415/164 |
| 2,858,666 | 11/1958 | Fullemann . | |
| 3,232,043 | 2/1966 | Birmann . | |
| 4,403,913 | 9/1983 | Fisker | 415/164 |
| 4,672,814 | 6/1987 | Abo et al. | 60/602 |
| 4,678,397 | 7/1987 | Komatsu et al. | 415/163 |

FOREIGN PATENT DOCUMENTS

| | | | |
|---|---|---|---|
| 0043305 | 1/1982 | European Pat. Off. . | |
| 0090122 | 10/1983 | European Pat. Off. . | |
| 0096624 | 12/1983 | European Pat. Off. . | |
| 766760 | 7/1934 | France . | |
| 1272830 | 4/1961 | France . | |
| 1512184 | 2/1968 | France . | |
| 2060271 | 6/1972 | Fed. Rep. of Germany . | |
| 2558878 | 7/1977 | Fed. Rep. of Germany . | |
| 0079622 | 5/1983 | Japan | 60/602 |
| 58-167825 | 10/1983 | Japan . | |
| 780621 | 8/1957 | United Kingdom . | |
| 1379075 | 1/1975 | United Kingdom . | |

OTHER PUBLICATIONS

Shames, *Mechanics of Fluids*, McGraw-Hill Book Company, 1962, pp. 168–169.

*Primary Examiner*—Robert E. Garrett
*Assistant Examiner*—Therese Newholm
*Attorney, Agent, or Firm*—Burns, Doane, Swecker & Mathis

[57] ABSTRACT

The turbine comprises orientable vanes or flaps (10*b*, 10*a*) respectively forming the distributor and a movable part of the volute of the turbine. These vanes are disposed in such manner that (a) the intrados (15) of one thereof directs the fluid which travels thereover in a path which is no longer in contact with the other, (b) the extrados (14*b*) of one of the vanes is travelled over by a fluid current which feeds the other vane and (c) the extrados (14*a*) of the other of the vanes is travelled over by a fluid current entering directly into the turbine only between its shaft (11*a*) and its trailing edge (13*a*). The turbine has application in the supercharging of engines of motor vehicles.

6 Claims, 2 Drawing Sheets

Figure 1:
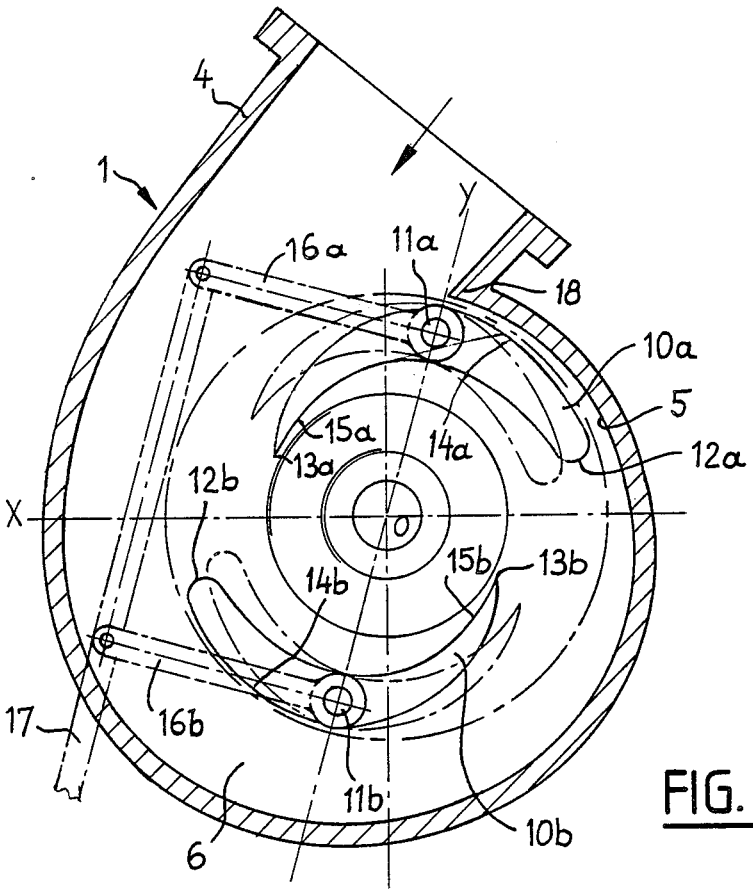

CENTRIPETAL OR HELICOCENTRIPETAL TURBINE COMPRISING A VOLUTE HAVING A VARIABLE GEOMETRY AND AN ORIENTABLE DISTRIBUTING VANE, IN PARTICULAR FOR A TURBOCOMPRESSOR FOR MOTOR VEHICLES

The invention relates to turbocompressors, and more particular to those used for supercharging engines of motor vehicles.

It is current practice in motor vehicles to employ engines supercharged by turbocompressors or turbochargers i.e. which comprise an air compressor increasing its density, this compressor being driven by a turbine disposed in the exhaust gases.

As the conditions of utilization of engines of vehicles are very variable, it is necessary to provide a device which limits the pressure of the air, which is usually achieved by adding to the turbine a by-pass valve which opens as soon as the pressure of the air exceeds a certain value.

However, owing to the loss of energy caused by the expansion of the gases in this pressure-reducing valve, it has recently been proposed to employ a turbine having a variable opening, i.e. capable of using different gas flows under the same pressure.

In particular, there has been used a device inspired from what is done in hydraulic turbines and consisting of a certain number of orientable distributors disposed in a ring arrangement around a wheel and fed in an identical manner by a casing which most often has a configuration like that of a shell of a snail.

However, for tourist vehicle engines, these distributors have relatively very small dimensions and are fragile, since they are subjected to blasts of the exhaust gases expelled from the cylinders at a high temperature and which are relatively corrosive. The mechanism for simultaneously controlling the directing vanes of these distributors is moreover complex and the cost of such equipment increases markedly the cost of a turbocompressor.

It has therefore been attempted to simplify such devices and to render them more strong and cheaper. Thus some have only one or two movable vanes which are portions of a volute, the latter being as it were deformable in a larger or lesser proportion.

The object of the present invention is to construct a centripetal or helicocentripetal turbine, in a motor vehicle turbocompressor, comprising a housing in the shape of a spiral including a part of variable geometry and an orientable directing vane.

For this purpose, the turbine in question is provided with means for regulating the flow of the fluid passing therethrough and is characterised in that said means comprise a first vane adjustable in position, mounted on a shaft and constituting a first movable portion of a volute, and a second vane adjustable in position mounted on a shaft and constituting an orientable director, these vanes being both arranged in such manner that the fluid which travels along the intrados of one of these vanes is no longer in contact with the second vane, that one of the vanes has an extrados travelled along by a fluid current which feeds the other vane, and that the extrados of the other vane is travelled over by a fluid current coming directly from the inlet of the turbine only between its shaft and its trailing edge, the part located between its shaft and its leading edge being in contact only with stagnant or practically stagnant fluid.

Figure 2:
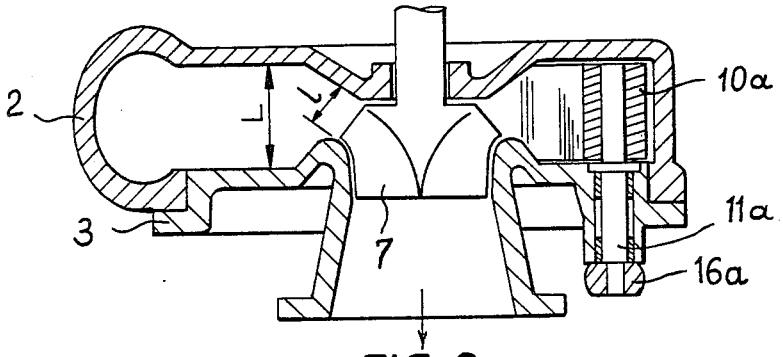
Figures 3, 4:
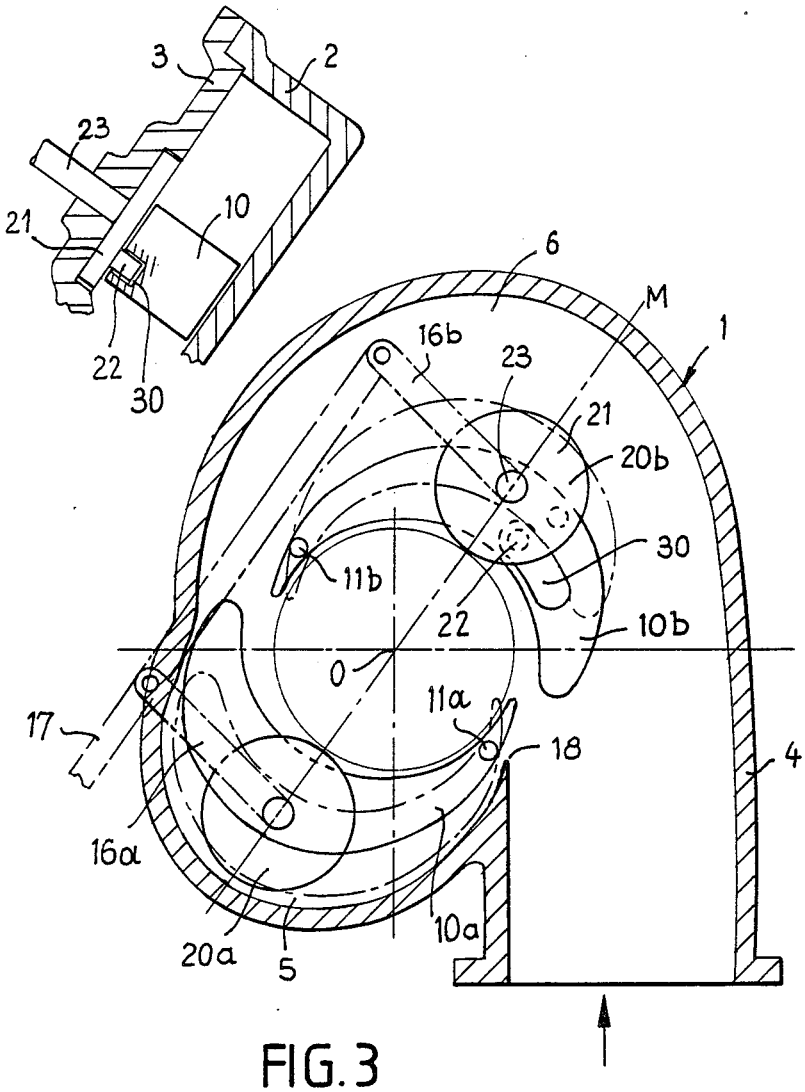

Other features of the invention will be apparent from the following description with reference to the drawings, in which:

FIG. 1 is a diagrammatic plan view, partly in section, of an embodiment of the invention;

FIG. 2.is a sectional view taken in planes X O Y of FIG. 1;

FIG. 3 is digrammatic plan view, partly in section, of another embodiment of the invention, and FIG. 4 is a partial sectional view taken in plane OM of FIG. 3.

The turbine for a turbocompressor or turbocharger according to the invention comprises a body 1 constituted by a housing 2 and a base 3 which are assembled by any suitable means. As can be seen, in particular in FIG. 1, this body defines a nozzle 4 which is extended by a volute 5 whose spiral shape defines a passageway 6. The body also contains a turbine wheel 7. This wheel carries receiving movable vanes; it is conventional and will therefore not be described in more detail and is merely shown diagrammatically in the drawing. In the conventional manner, the exhaust gases enter through the nozzle, travel through the spiral-shaped passage and are directed toward the centre where they come into contact with the blades of the wheel 7 which is rotated thereby. In the known manner, this wheel drives a compressor, not shown, which serves to supply the fuel to the engine. As these elements are well known in the automobile art, they will not be explained at more length in the following description, which will be restricted to the means which are part of the invention and to the means directly or indirectly relating thereto.

With reference to FIG. 1, it can be seen that the turbine comprises two directing vanes or flaps 10*a* and 10*b* which are each pivotally mounted by means of a pivot shaft 11*a* and 11*b* respectively; these shafts are parallel to the axis of the wheel 7. These two vanes thus mounted to be movable are capable of pivoting about these shafts in such manner as to be shifted and to change orientation. Each of the vanes has a leading edge 12*a* and 12*b*, a trailing edge 13*a* and 13*b*, an extrados 14*a* and 14*b* and an intrados 15*a* and 15*b* respectively.

As can be seen more particularly in FIG. 2, a shaft 11*a* is used in the manner of a pintle which is in one piece with or connected to the vane in any suitable manner so as to be rotatable therewith. Levers 16*a*, 16*b* are keyed on the shafts 11*a*, 11*b* respectively, as shown in the drawing, by pins, bolts, splines, interference fits, welding or other means. These levers are connected to a common rod 17 by suitable articulations, not shown in detail. Any type of articulation, for example by means of a pin, a groove and stud, may be suitable as long as it defines an axis of rotation substantially parallel to that of the vanes.

As can be seen in particular in FIG. 1, the vanes occupy positions which are symmetrical relative to the axis of rotation of the wheel and the levers are located on the same side of a diameter. Owing to the linkage shown in the drawings, which comprises the rod 17 and the two levers 16*a* and 16*b*, it can be seen that, when the rod is pushed or pulled, the two vanes are pivoted in such manner that their leading edge moves toward or away from the axis of the wheel, as shown in full line and dotted line respectively, where the vanes are drawn in the end positions they are capable of occupying.

As is clear from FIG. 1, according to the invention, one of the vanes, the vane 10*a*, constitutes a deformable part of the volute 5 of the spiral-shaped casing and the other vane 10*b* constitutes an orientable directing vane or blade.

With reference again to FIG. 1, it will be observed that the first vane 10*a* is in contact with the fluid current only partially, while the other vane 10*b* is immersed in the fluid and is in contact therewith by its two sides, namely its extrados 14*b* and its intrados 15*b*.

The design of the two vanes is such that their trailing edges 13*a* and 13*b* are of minimum thickness.

As can be seen from FIG. 1, each of the two vanes, which are disposed symmetrically relative to the axis of the turbine, feeds one half of the circumference of the wheel, so that the fluid current which travels along the intrados of any one of the vanes is subsequently no longer in contact with the other vane.

In this diagrammatically represented embodiment, it is assumed that the two vanes are identical, although this is not essential. However, it will be observed that in order to avoid dissymetry in the flow on the wheel, vanes having identical intrados profiles are used.

Further, it will be observed that the leading edges 12*a* and 12*b* have a rounded profile, so that, irrespective of the position occupied by the vanes, they can be passed around without this causing the fluid which flows close thereto to become detached therefrom.

As can be seen from FIGS. 1 and 2, the two vanes or flaps 10*a* and 10*b* are disposed in a case or housing 2 which, in cooperation with the base 3, delimits the passage which passes around the extrados of the vane 10*b* in such manner that, at the maximum opening, the speed of the fluid be sufficiently low to ensure that friction is practically nil. It will also be noticed that this housing delimits the nozzle 4 through which the fluid enters the turbine. This nozzle is connected to the housing by a nose portion 18. This nose portion is in vertical alignment with the pivot shaft 11*a* so that, in this region, the clearance between the vane and the nose portion is as small as possible so that the current which would possibly travel along the extrados 14*a* is small and the extrados part of the trailing edge of this vane 10*a* is fed directly with air by the inlet nozzle. The part of the extrados 14*a* located between the leading edge and the nose portion 18 or the shaft 11*a* is in contact with a quasi-stagnant fluid.

According to another important feature of the invention, the width L of the vanes which is also the distance between the parallel wall parts of the housing and of the base between which the vanes move, is larger in a marked manner than the width 1 of the entrance of the wheel 7.

Owing to this arrangement, a great convergence is obtained at the entrance of the wheel, which has for result to minimize the effect of the drags of the two vanes and in this way produce an increase in the efficiency and a reduction in the periodical mechanical forces on the blading of the wheel. The maximum angular movement between the end positions of the two vanes is also in this way reduced, which avoids, in the largest opening position, that their trailing edges move excessively toward the wheel and also that their leading edges be spaced excessively away from the center, which permits a reduction in the size of the housing.

It is clear that the position of the pivot shaft of the vanes and the manner in which they are controlled may be chosen judiciously.

As can be seen in the embodiment shown in FIG. 1, the pivot shaft 11*a* and the pivot shaft 11*b* are located roughly in the middle of the length of the vane or flap, which requires that this shaft be very strong and this determines the minimum thickness of the vane or flap.

Reference will now be made to FIGS. 3 and 4, which shown another embodiment.

The elements when they are indicated by the same reference numerals are similar and perform the same functions. They consequently need not be described.

As can be seen here, the shafts 11*a* and 11*b* are located as close as possible to the trailing edges 13*a* and 13*b* of the vanes 10*a* and 10*b* respectively, but this time they are not used for controlling their orientation. The orientation of the vanes is here controlled by cams 20*a* and 20*b*. As can be seen in particular in FIG. 4, each cam comprises a plate 21 which carries a pin 22 and is extended on the other side of the plate by a stem 23. Each pin 22 is engaged in a complementary groove 30 provided in the corresponding vane. The profile of the groove is so chosen that the pivoting of the vane is progressive. Keyed on the stem of each cam is a lever connected by an articulation to a rod, as indicated in respect of the first embodiment.

In this embodiment, as in the embodiment described with reference to FIGS. 1 and 2, the single control rod is associated with a regulator which regulates its position, and therefore the orientation of the vanes, which thus act on the flow of the turbocompressor.

The embodiment shown in FIGS. 3 and 4 is somewhat more complex but has the advantage that each vane is maintained at two points which renders them less sensitive to the vibratory forces produced by the blasts of the exhaust gases from the cylinders.

What is claimed is:

1. A centripetal or helicocentripetal turbine comprising a turbine body defining a volute and a turbine wheel having an axis of rotation, means for regulating a flow of fluid through the turbine, said means comprising a pivot shaft rotatively mounted relative to said body, a first orientation vane mounted on said shaft and constituting a movable part of said volute, a second pivot shaft rotatively mounted relative to said body and a second orientable directing vane mounted on said second shaft and constituting an orientable directing vane, said vanes each having a leading edge and a trailing edge relatiave to the direction flow of said fluid, an intrados and an extrados and being disposed in such manner that the intrados of one of the vanes directs a fluid current travelling thereover in a path which is no longer in contact with the other vane, the extrados of the one of the vanes has travelling thereover a fluid current which feeds the other vane that is surrounded by that fluid current, and the extrados of the one of the vanes is travelled over by a fluid current entering directly in the turbine only between its shaft and its trailing edge so that the extrados of the one of the vanes is in contact only with stagnant or substantially stagnant fluid between its shaft and its leading edge.

2. A turbine according to claim 1, wherein the vanes are disposed in a part of the body of the turbine which has two walls perpendicular to the axis of rotation of the wheel of the turbine, the distance between said walls being greater than the width of an entrance of the wheel.

3. A turbine according to claim 1, wherein the pivot shaft of each vane is located substantially in the middle of its length, the turbine further comprising for simultaneously orienting the vanes a linkage which includes two levers connected to rotate with the shafts of the vanes and a single control rod combined with said levers for being controlled by a suitable regulator.

4. A turbine according to claim 1, wherein the shaft of each vane is located close to its trailing edge, the turbine further comprising cams placed adjacent to the leading edge of the vanes and cooperative with the vanes to that said vanes are supported at two distinct and remote points, two levers drivingly connected respectively to the cams so as to control the position of the cams, and a single control rod combined with the levers for being controlled by a suitable regulator.

5. A turbine according to claim 4, wherein said cams comprise a rotatable disc, an eccentric pin mounted on the disc and a recess in the respective vane in which recess the eccentric pin is engaged for driving the vane upon rotation of the disc.

6. A turbocompressor for supercharging an engine of an automobile, said turbocompressor comprising a centripetal or helicocentripetal turbine comprising a turbine body defining a volute and a turbine wheel having an axis of rotation, means for regulating the flow of fluid through the turbine, said means comprising a pivot shaft rotatively mounted relative to said body, a first orientation vane mounted on said shaft and constituting a movable part of said volute, a second pivot shaft rotatively mounted relative to said body and a second orientable vane mounted on said second shaft and constituting an orientable directing vane surrounded by fluid, said vanes each having a leading edge and a trailing edge relative to the direction flow of said fluid, an intrados and an extrados and being disposed in such manner that the intrados of one of the vanes directs the fluid current travelling thereover in a path which is no longer in contact with the other vane, the extrados of one of the vanes has travelling thereover a fluid current which feeds the other vane and the extrados of the vanes is travelled over by a fluid current entering directly in the turbine only between its shaft and its leading edge.

* * * * *